US005099405A

United States Patent [19]

Gehly et al.

[11] Patent Number: 5,099,405

[45] Date of Patent: Mar. 24, 1992

[54] LAMP CHANGE MECHANISM

[75] Inventors: Joel C. Gehly, McKean; James M. Szumigala, Erie, both of Pa.

[73] Assignee: American Sterilizer Company, Erie, Pa.

[21] Appl. No.: 495,252

[22] Filed: Mar. 16, 1990

[51] Int. Cl.[5] ..... F21L 15/12

[52] U.S. Cl. ..... 362/400; 362/804; 362/306; 362/372; 362/287

[58] Field of Search ..... 362/226, 804, 372, 306, 362/349, 399, 405, 232, 429, 285, 287, 288; 128/22, 23

[56] References Cited

U.S. PATENT DOCUMENTS 2,226,300 12/1940 Alexander .

4,037,096 7/1977 Brendgord et al. ..... 362/298

4,288,844 9/1981 Fisher et al. ..... 362/297

4,395,750 7/1983 Schneidemann et al. ..... 362/298

4,578,742 3/1986 Klein et al. ..... 362/294

4,937,715 6/1990 O'Shea et al. ..... 362/804

*Primary Examiner*—Ira S. Lazarus

*Assistant Examiner*—D. M. Cox

*Attorney, Agent, or Firm*—Kirkpatrick & Lockhart

[57] ABSTRACT

An apparatus is provided for a lighthead which allows the lamp to be serviced without removing any components of the lighthead. The invention includes a lamp socket connected to the handle of the lighthead. The handle can be displaced from an operative position to expose the lamp for maintenance while remaining attached to the lighthead to prevent damage or loss of the components.

8 Claims, 4 Drawing Sheets

LAMP CHANGE MECHANISM

BACKGROUND OF THE INVENTION

1. Field of the Invention

The present invention relates generally to lightheads and more particularly to lightheads of the type in which the lamp socket can be easily accessed for maintenance purposes.

2. Description of the Prior Art

In lightheads found in the prior art, lamps having one or more filaments are provided which generate useful light. Those lamps have a rated useful life after which time the lamp typically fails. Lamps may fail before the rated life is obtained because of unusual operating conditions or the like. Lamps may also fail due to mechanical shock or damage.

The lamp is positioned in the lighthead within an electrical socket having a pair of contacts positioned therein. Those contacts are subject to burning out due to the high currents conducted therethrough. Thus it is necessary to access the lamp and socket within the lighthead to effect repairs or simply to conduct routine maintenance.

To access the lamp or socket, some prior art lightheads have to be partially disassembled or the lamp socket has to be detached completely from the lighthead. Often times tools are required to gain access to the lamp. If the lamp socket is removed from the lighthead and detached completely for maintenance, there is a risk of losing parts or dropping and breaking components. Another problem that may occur when the lamp socket is removed, is that the weight of the socket assembly is born by the electrical conductors.

Accordingly, the need exists for a lighthead that has a lamp socket which can be displaced from its operative position to expose the lamp for maintenance but remains attached to the lighthead to prevent damage or loss of the components.

SUMMARY OF THE PRESENT INVENTION

The present invention is directed to a lamp replacement mechanism that provides a lamp socket which can be displaced from its operative position to expose the lamp for maintenance but which remains attached to the lighthead to prevent damage or loss of the components. The lighthead includes an optical core and a reflective member partially surrounding the optical core. The reflective member defines an open end from which usable light is emitted. A lens member is positioned across the open end and has an opening substantially coinciding with the optical core.

A handle member is connected to the optical core within the opening provided in the lens member and extends beyond the lens member to facilitate manipulation of the lighthead. The lamp socket is connected to the handle member. The handle member is connected to the optical core through a device that enables the lamp socket to assume one of two positions: an operating position and a service position. In the operating position, the lamp socket is held at a desired location within the optical core. In that position, the lighthead can operate to project light onto a desired area such as an operating table. In the service position, the lamp socket is held outside of the optical core so that the lamp socket may be accessed for maintenance.

According to one embodiment of the present invention, the handle member is both slidably and hingedly connected to the optical core. That enables the lamp socket to slide downward out of the optical core and then rotate to afford convenient access in the service position.

According to another embodiment of the present invention, the handle member is held in place by captive, knurled, screws. Upon loosening those screws, the aforementioned downward and rotating motions can be achieved. In that manner, the lamp and socket are easily accessed without disconnecting or removing any parts of the lighthead. The weight of the lamp and socket are born by the device which connects the handle member to the optical core. There is no possibility of dropping or losing parts. These and other advantages and benefits of the present invention will become apparent from the Detailed Description of a Preferred Embodiment hereinbelow.

BRIEF DESCRIPTION OF THE DRAWINGS

For the present invention to be readily practiced and easily understood, it will be described, by way of example only, in conjunction with a preferred embodiment in which.

DETAILED DESCRIPTION OF A PREFERRED EMBODIMENT

FIGS. 1–4 illustrate a preferred embodiment of the present invention. Although the present invention is described in conjunction with the surgical lighthead 10, it will be understood that the present invention may be used in conjunction with other types of lightheads.

Figure 1:
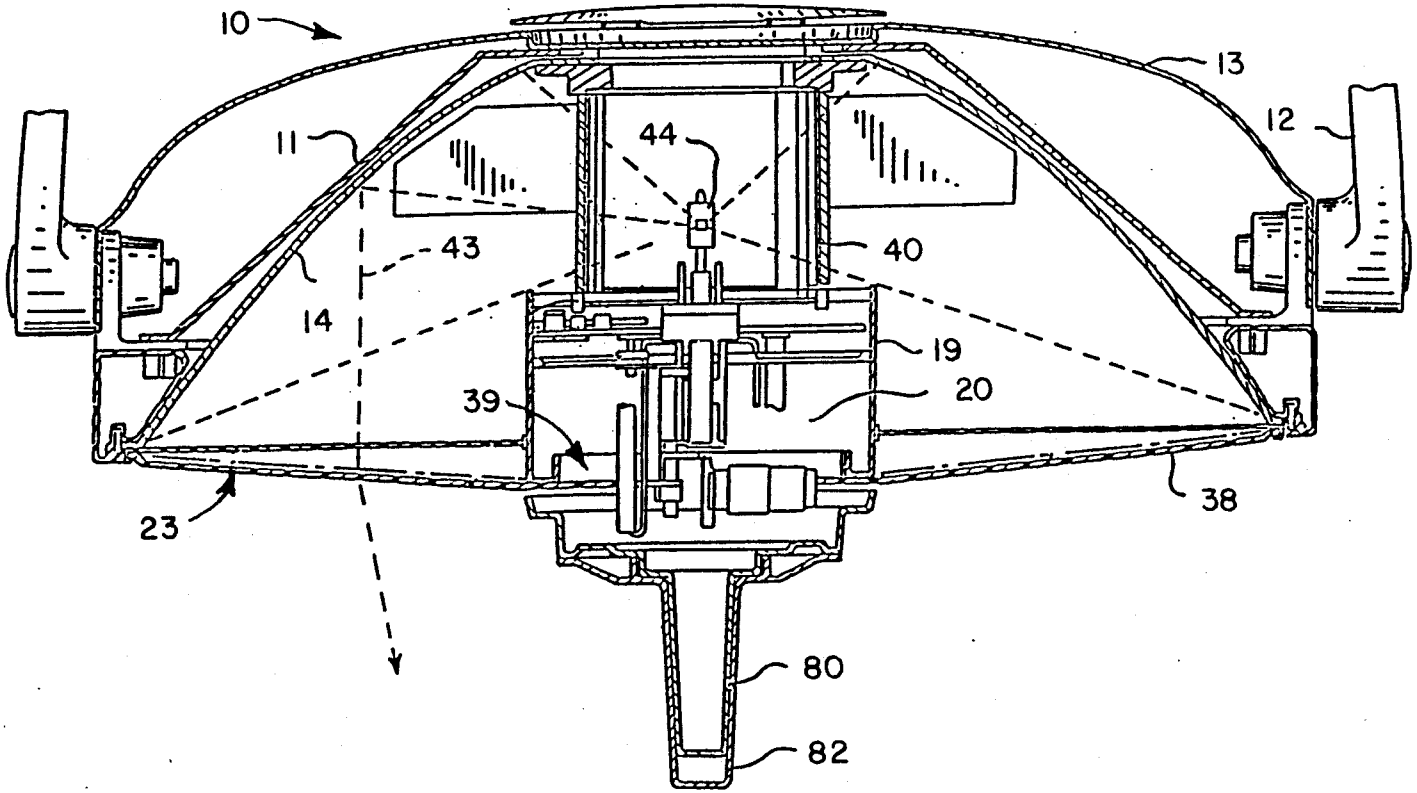
FIG. 1 illustrates a surgical lighthead incorporating the lamp change mechanism of the present invention.

The lighthead 10 illustrated in FIG. 1 is comprised of a central support 11. The central support 11 is connected to a yoke 12, partially shown, as is known. The yoke 12 may be connected to a suspension system (not shown) as is conventional in the art. The remainder of the components of the lighthead 10 are connected either directly, or indirectly, to the support structure 11.

An outer cover 13 is connected to the support structure 11 as shown in FIG. 1. A cylindrical member 19 is suspended from the support structure 11 and defines an area within the lighthead 10 known as the optical core 20. A reflective member 14 substantially surrounds the optical core 20 and defines an open end 23 from which usable light emanates. A lens member 38 is positioned across the opening 23. The lens member 38 has an opening 39 therethrough substantially coinciding with the optical core 20. The lens member 38 is connected to the member 19 defining the optical core 20 by nut and bolt combinations 110 and 112 seen in FIG. 2. A sterile handle support 80 is provided which is typically covered by a sterile handle cover 82 so that a surgeon, or other member of the surgical team, can adjust the position of the surgical lighthead 10.

Figure 2:
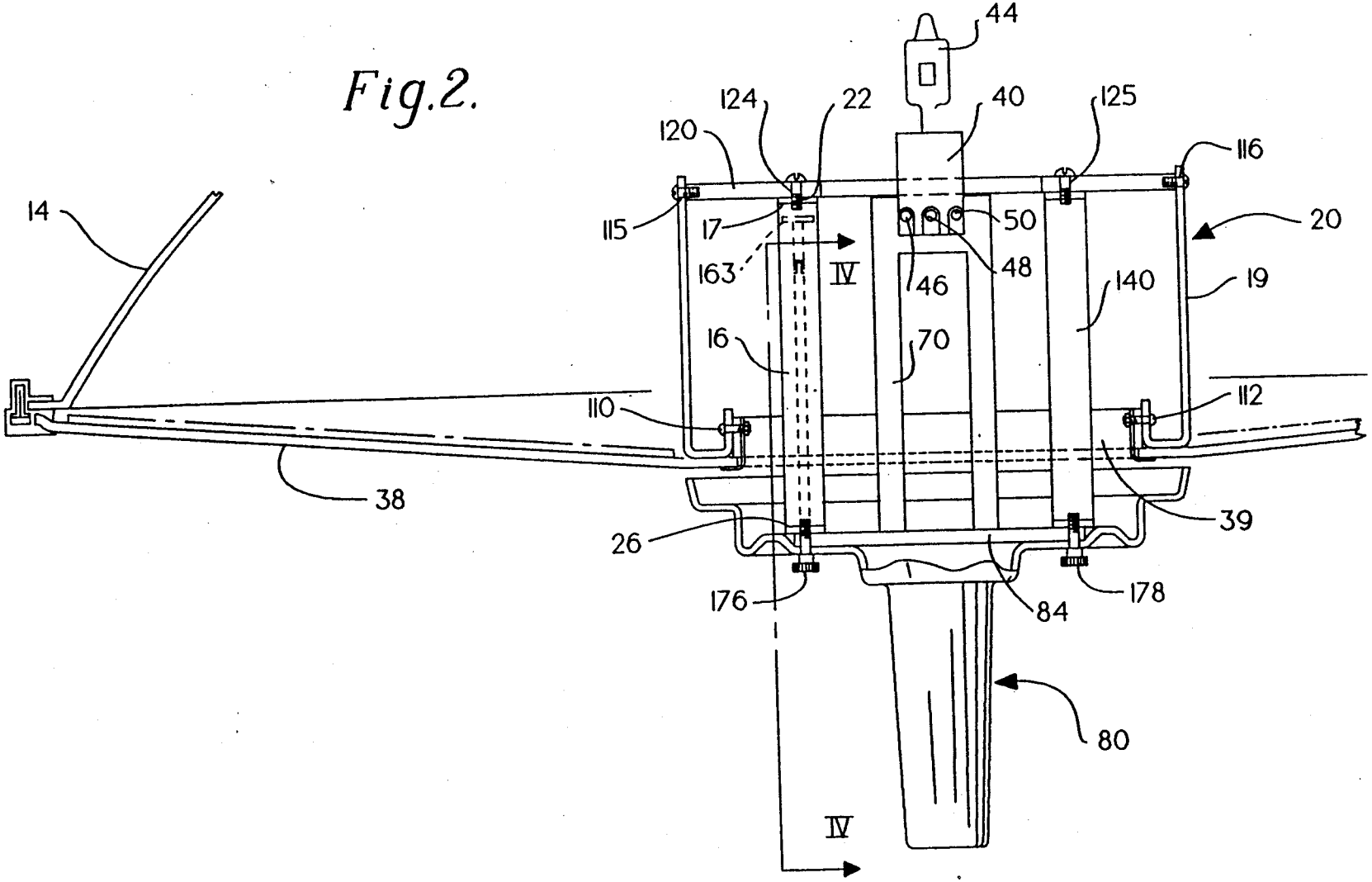
FIG. 2 is a view of the surgical lighthead with the lamp in the operative position.

A U-shaped bracket 70, seen best in FIG. 2, rigidly connects a lamp socket 40 to the sterile handle support 80. The lamp socket 40 is adapted to carry a lamp 44 as is known.

In operation, the lamp 44, when appropriately positioned within the optical core 20, produces flux which is reflected by reflector 14, passes through lens member 38, and is focused upon a desired object as shown by the representative light ray 43.

An important feature of the present invention is the manner in which the sterile handle support 80 is connected to the optical core 20.

Turning to FIG. 2, at the upper portion of the cylindrical member 19, holes 115 and 116 are provided. The holes 115 and 116 are used to retain a lamp plate 120. The lamp plate 120 has four holes, two of which 124 and 125 are seen in FIG. 2. The purpose of the four holes will be described in more detail hereinafter.

The lamp socket 40 has three holes 46, 48 and 50 located at the bottom thereof as seen best in FIG. 2. The U-shaped bracket 70 has three corresponding holes (not shown), at the upper end thereof so that the lamp socket 40 can be rigidly connected to the U-shaped bracket 70 by means of screws 52, 54 and 56 seen in FIG. 3. In that manner, the lamp socket 40 is rigidly connected to, and travels with, the U-shaped bracket 70.

Figure 3:
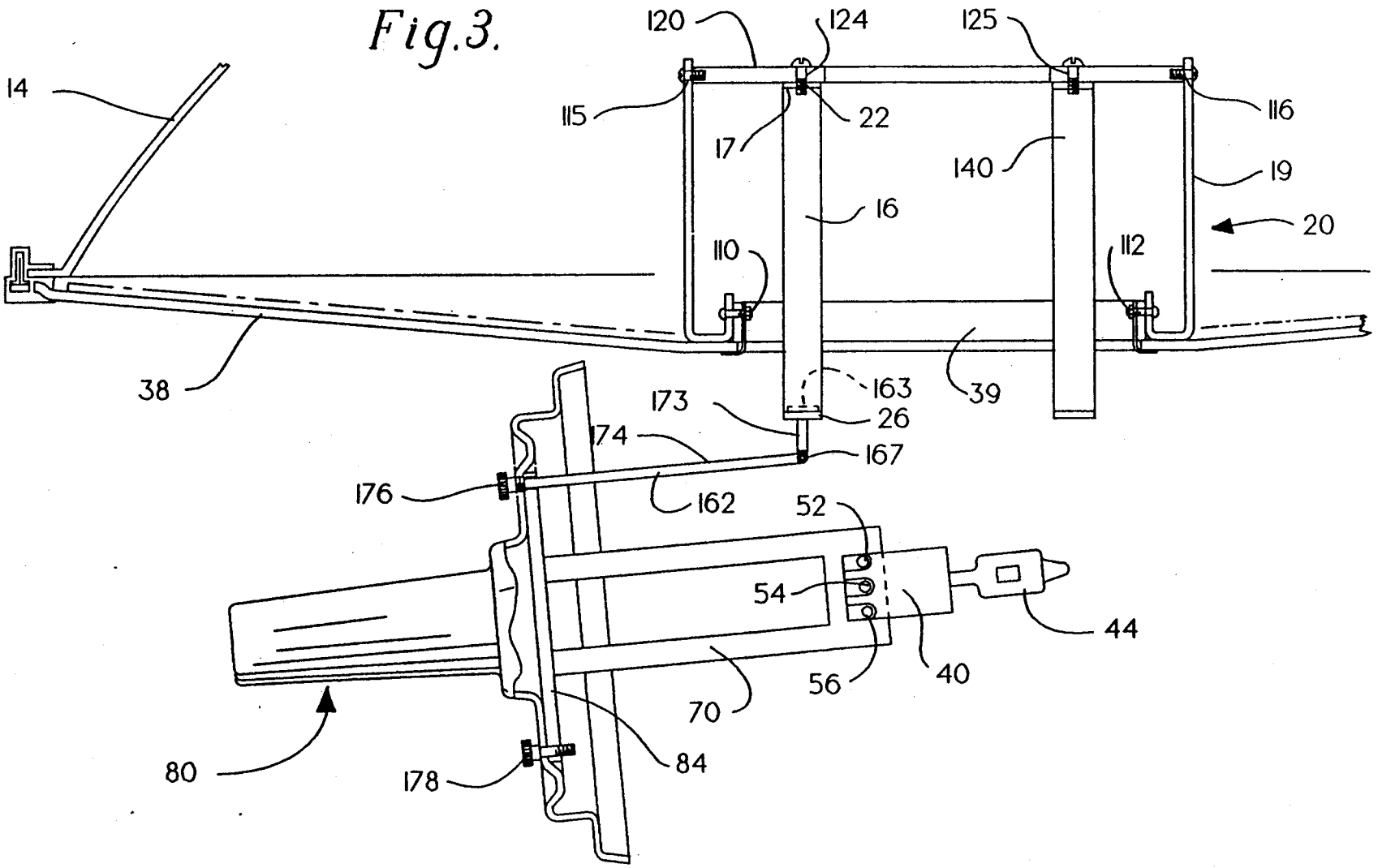
FIG. 3 is a view of the surgical lighthead with the lamp in the service position.

The sterile handle support 80 carries an attachment plate 84 as seen in FIGS. 2 and 3. The U-shaped bracket 70 is rigidly connected to the attachment plate 84 in any conventional manner. Thus, the lamp 44, lamp socket 40 and U-shaped bracket 70 move in unison with the sterile handle support 80.

Located within the optical core 20 are two parallel mounting brackets 16 and 18. At the top end 17 of the mounting bracket 16 is a hole 22 which coincides with the hole 124 in the lamp plate 120. Through the use of a nut and bolt combination, the upper end 17 of the mounting bracket 16 may be rigidly connected to the lamp plate 120.

The upper end 21 of the mounting bracket 18 similarly contains a hole, not shown, which coincides with the hole (not shown) in the lamp plate 120. Through a nut and bolt combination, the upper end 21 of the mounting bracket 18 is rigidly connected to the lamp plate 120.

At the bottom ends of the mounting brackets 16 and 18, each mounting bracket 16 and 18 is provided with a horizontally extending portion 26 and 28, respectively. The horizontally extending portions 26 and 28 each have a guide hole 30 and 32, respectively, and a mounting hole 34 and 36, respectively. The purpose of the guide holes and mounting holes will be explained in detail herein below.

Also located within the optical core 20 are a pair of standoff rods, one of which 140 is shown in the figures. The upper end of standoff rod 140 is connected to the lamp plate 120 through a bolt extending through the hole 125 in lamp plate 120. The other standoff rod is similarly rigidly attached to the lamp plate 120. The lower ends of the standoff rods have internal threads, the use of which will become apparent from the description hereinbelow.

Two hinged guide rods 160 and 162 are rigidly attached to the attachment plate 84 of the sterile handle support 80 by bolts 164 and 166, respectively. The guide rods 160 and 162 extend through guide holes 32 and 30, respectively. The guide rods 160 and 162 have stops 161 and 163, respectively, at the upper ends which are too large to fit through guide holes 32 and 30, respectively. Thus, although the guide rods 160 and 162 may slide along their entire length through guide holes 32 and 30, respectively, the stops prevent the guide rods from passing beyond horizontal extending portions 26 and 28.

Two captive, knurled, thumb screws 174 and 176 connect the attachment plate 84 to the mounting brackets 18 and 16 at holes 36 and 34, respectively. Additionally, a knurled thumb screw 178 is used to connect the attachment plate 84 to the standoff rod 140 by means of the internal threads at the lower end thereof. Although not shown, the second standoff rod is similarly connected to the attachment plate by a knurled thumb screw.

When all of the captive thumb screws are loosened, there is no connection between the attachment plate 84 and either the standoff rods or the mounting brackets 16 and 18. The only connection between the attachment plate 84 and the remainder of the lighthead 10 is through the guide rods 160 and 162. Because the guide rods 160 and 162 are of a smaller diameter throughout their length than the guide holes 32 and 30, respectively, the sterile handle support 80, U-shaped bracket 70, lamp socket 40, and lamp 44 slide downwardly such that the aforementioned components slide out of the optical core 20. Downward movement of the aforementioned components ends when the stops 161 and 163 contact horizontal members 28 and 26, respectively.

The guide rods 160 and 162 have upper sections and lower sections. In FIG. 3, the guide rod 162 can be seen with an upper section 173 and a lower section 174 connected by a hinge 167 which allows the lower section 174 to rotate with respect to the upper section 174. The guide rod 160 is similarly construed and has a hinge 165. Once outside of the optical core 20, the hinges 165 and 167 in the guide rods 160 and 162, respectively, may be operated to rotate the sterile handle support into the position shown in FIG. 3. Accordingly, the lamp change mechanism enables the lamp 44 to assume two positions: an operating position wherein the lamp 44 is positioned within the optical core 20 so that the lighthead 10 can produce usable light, and a service position as shown in FIG. 3 wherein the lamp 44 and socket 40 can be easily reached for servicing.

When servicing is completed, the sterile handle support 80 is rotated into a vertical position, and slides upwardly until each of the four knurled captive thumb screws contacts its mating threads. Upon tightening of the thumb screws, the sterile handle support 80 is firmly connected to mounting brackets 16 and 18 and the standoff rods.

It is apparent from the foregoing description, that when in the service position, the weight of the sterile handle support 80, and the components attached thereto, is borne by the guide rods 160 and 162. Because all components remain attached to the lighthead, it is impossible to drop or lose parts. The lamp 44 and socket 40 can be quickly and easily accessed for service. Those features clearly represent an advance over the art.

While the present invention has been described in conjunction with a preferred embodiment, many modifications and variations will be readily apparent to those of ordinary skill in the art. This disclosure and the following claims are intended to cover all such modifications and variations.

What is claimed is:

1. A lighthead having a lamp change mechanism, comprising:

a member defining an optical core within the lighthead;

a reflective member partially surrounding said optical core and defining an open-end from which usable light is emitted;

a lens member positioned across said open end and having an opening therethrough substantially coinciding with said optical core;

a lamp socket;

a handle member rigidly connected to said lamp socket; and means for connecting said handle member to said optical core within said opening in said lens member i) in an operative position wherein said lamp socket is held at a desired location within said optical core, and ii) in a service position wherein said lamp socket is held at a location outside of said optical core, said means for connecting said handle member to said optical core comprising a plurality of guide rods rigidly connected to said handle member, and fastening means for slidably connecting said guide rods to said member defining said optical core to enable said handle member to assume said operative and said service positions.

2. A lighthead having a lamp change mechanism as recited in claim 1 wherein said fastening means for slidably connecting said guide rods to said member defining said optical core includes a plurality of L-shaped mounting brackets each having a vertical portion rigidly connected to said member defining said optical core and a horizontal portion having an aperture therethrough, said guide rods being positioned within said apertures thereby enabling said handle member to slidably assume said operative and said service positions.

3. A lighthead having a lamp change mechanism as recited in claim 2 wherein each of said guide rods has an upper portion having a stop member limiting the downward travel of said guide rod within said aperture, and a lower portion, said upper and lower portions hingably connected to enable said handle member to be rotated into said service position.

4. A lighthead having a lamp change mechanism as recited in claim 3 additionally comprising a plurality of knurled thumbscrews captively held in said handle member, and wherein said means for connecting said handle member to said member defining said optical core includes a plurality of standoff rods, each rod having an upper portion rigidly connected to said member defining said optical core and a lower portion releasably connected to said handle member by said plurality of said knurled thumbscrews.

5. A lighthead having a lamp change mechanism as recited in claim 4 wherein each of said horizontal portions of said L-shaped mounting brackets has a second threaded aperture therein, said handle member being releasably connected to said L-shaped mounting brackets through the cooperation of said second threaded apertures and said plurality of knurled thumbscrews.

6. A lighthead having a lamp change mechanism as recited in claim 5 further comprising a U-shaped bracket for connecting said lamp socket to said handle member.

7. A lighthead having a lamp change mechanism, comprising:

a member defining an optical core within the lighthead;

a reflective member partially surrounding said optical core and defining an open end from which usable light is emitted;

a lens member positioned across said open end and having an opening therethrough substantially coinciding with said optical core;

a lamp socket;

a handle member rigidly connected to said lamp socket;

a plurality of guide rods each having an upper portion and a lower portion hingedly connected thereto, each of said lower portions rigidly connected to said handle member, each of said upper portions having a stop member; and a plurality of L-shaped mounting brackets equal in number and positioned parallel to said guide rods, each mounting bracket having a vertical portion rigidly connected to said member defining said optical core and a horizontal portion, each of said horizontal portions having an aperture therethrough slidably receiving a guide rod thereby enabling said handle to assume an operative position and a service position, the downward travel of each guide rod being limited by said stop member.

8. A lighthead having a lamp change mechanism as recited in claim 7 additionally comprising a plurality of knurled thumbscrew captively held by said handle member and a plurality of standoff rods each having an upper portion rigidly connected to said member defining said optical core and a lower portion, said lower portion having threaded apertures to receive said knurled thumbscrews thereby enabling said handle member to be releasably connected to said standoff rods.

* * * * *

UNITED STATES PATENT AND TRADEMARK OFFICE

CERTIFICATE OF CORRECTION

PATENT NO. : 5,099,405
DATED : March 24, 1992
INVENTOR(S) : Joel C. Gehly and James Szumigala

It is certified that error appears in the above-identified patent and that said Letters Patent is hereby corrected as shown below:

In the Drawings:

In FIG. 3, delete number "176" and substitute --166-- therefor.

Figure 4:
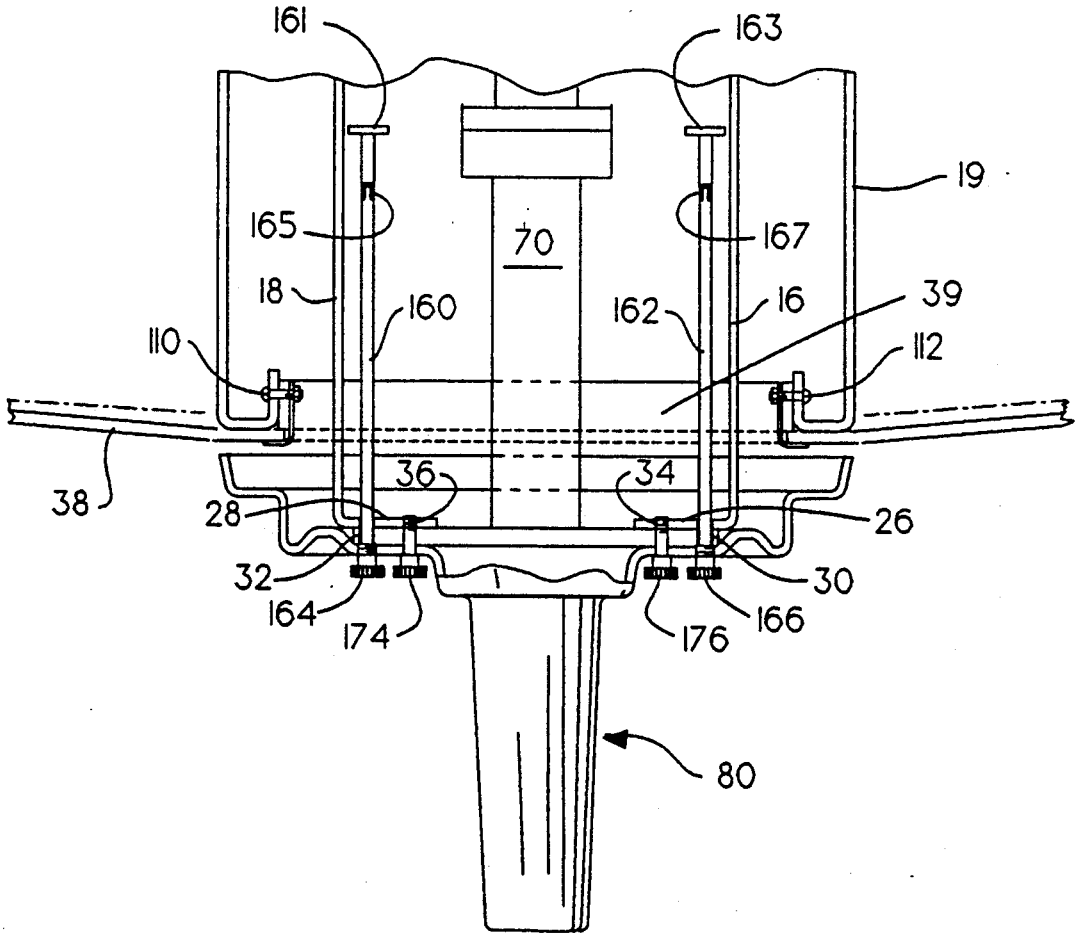
FIG. 4 is a sectional view of the lighthead shown in FIG. 2 taken along the lines IV—IV.

In FIG. 4, delete number "174" and substitute --179-- therefor.

Col. 4, line 3, delete "174" and substitute --179-- therefor.

Col. 4, line 31, after "upper section", delete "174" and substitute --173-- therefor.

Col. 4, line 32, delete "construced" and substitute --constructed--therefor.

Signed and Sealed this

Twentieth Day of July, 1993

*Attest:*

Michael K. Kirk

MICHAEL K. KIRK

*Attesting Officer*

*Acting Commissioner of Patents and Trademarks*